US005853226A

United States Patent [19]

Lee

[11] Patent Number: 5,853,226

[45] Date of Patent: Dec. 29, 1998

[54] HIGH PERFORMANCE IN-LINE ROLLER SKATE WHEELS WITH PERMEABLE CORES

[76] Inventor: Charles J. Lee, 11404 Prescott La., Westchester, Ill. 60154

[21] Appl. No.: 661,602

[22] Filed: Jun. 11, 1996

[51] Int. Cl.[6] ..... B60B 5/02

[52] U.S. Cl. ..... 301/5.3; 301/64.7

[58] Field of Search ..... 301/5.3, 5.7, 64.7, 301/64.5; 152/5, 7, 323, 326, 327, 328, 329; 280/11.22, 11.23

[56] References Cited

U.S. PATENT DOCUMENTS

| | | | |
|---|---|---|---|
| D. 341,863 | 11/1993 | Cavasin | D21/226 |
| D. 342,113 | 12/1993 | Cavasin | D21/226 |
| D. 343,669 | 1/1994 | Pratt | D21/226 |
| D. 345,405 | 3/1994 | Cavasin | D21/226 |
| D. 346,192 | 4/1994 | Miller et al. | D21/226 |
| D. 346,633 | 5/1994 | Conte | D21/226 |
| D. 347,672 | 6/1994 | Arney et al. | D21/226 |
| 2,871,061 | 1/1959 | Beitou et al. | 301/5.3 |
| 3,578,812 | 5/1971 | Taussig | 301/64.7 |
| 3,807,474 | 4/1974 | Wendt et al. | 301/64.7 X |
| 3,843,202 | 10/1974 | Lacerte | 301/64.7 |
| 4,818,034 | 4/1989 | Djerf | 301/64.5 X |
| 4,909,523 | 3/1990 | Olson | 280/11.2 |
| 5,048,848 | 9/1991 | Olson et al. | 180/11.22 |
| 5,068,956 | 12/1991 | Malewicz | 29/437 |
| 5,183,276 | 2/1993 | Pratt | 280/11.22 |
| 5,190,301 | 3/1993 | Malewicz | 280/11.22 |
| 5,199,727 | 4/1993 | Lai | 280/11.2 |
| 5,207,454 | 5/1993 | Blankburg et al. | 280/843 |
| 5,271,633 | 12/1993 | Hill, Jr. | 280/11.22 |
| 5,286,043 | 2/1994 | Tkaczyk | 280/11.22 |
| 5,303,940 | 4/1994 | Brandner | 280/11.22 |
| 5,308,152 | 5/1994 | Ho | 301/5.3 |
| 5,310,250 | 5/1994 | Gonsior | 301/5.3 |
| 5,312,844 | 5/1994 | Gonsior | 521/99 |
| 5,356,209 | 10/1994 | Hill | 301/5.7 |
| 5,374,072 | 12/1994 | Landers | 280/11.2 |
| 5,401,037 | 3/1995 | O'Donnell et al. | 280/11.2 |
| 5,567,019 | 10/1996 | Raza et al. | 301/64.7 X |
| 5,573,309 | 11/1996 | Bekessy | 301/64.7 X |

*Primary Examiner*—Russell D. Stormer
*Attorney, Agent, or Firm*—Thomas W. Tolpin

[57] ABSTRACT

High performance, light-weight skate wheels are produced with special permeable cores and without air bubbles for in-line roller skates to attain greater strength, speed, maneuverability and control. In order to facilitate rotation, one or more bearings are seated in the hub of the gas permeable core. The gas permeable core which is preferably made of high-impact plastic can be reinforced with fibers. The gas permeable core can also comprise complementary core sections and can have an array of spokes which connect a hub and an inner rim. In the preferred form, the gas permeable core has an outer portion providing a hollow shell upon which a high performance non-pneumatic tire is secured. In order to prevent air bubbles from forming in the solidified core during molding, the core is formed with gas passageways, such as vent holes, openings, tunnels, air channels, micropores or apertures. Preferably, the micropores or apertures are formed in the tire-engaging surface of the gas permeable core. The core can also have spikes, deflectors or indentations to minimize gas deflection and turbulence during molding in order to produce a more homogeneous core. Interlocking fingers or hollow pins and sockets can also be used to securely connect complementary core sections.

14 Claims, 7 Drawing Sheets

HIGH PERFORMANCE IN-LINE ROLLER SKATE WHEELS WITH PERMEABLE CORES

BACKGROUND OF THE INVENTION

This invention pertains to roller skates and, more particularly, to in-line roller skate wheels.

Before the popularity of in-line roller skating, roller skaters typically used quad-type roller skates with a pair of wheels or rollers at the front near the toe and a pair of wheels at the back near the heel. Quad-type pairs of wheels or rollers were usually mounted on trucks or casters upon frames which were attached to shoes or boots. The wheels were often made of metal. The popularity of quad-type roller skates has been surpassed by in-line roller skates.

In-line or linear roller skates utilize two or more wheels positioned to rotate within a common plane along a straight line. To many skaters, in-line roller skates have a feel and behavior often associated with ice skates, i.e. similar body movements are utilized to operate both ice skates and in-line roller skates. In-line roller skates have become increasingly popular with ice skaters as a training tool for off season and for use on sidewalks, driveways and streets. In-line roller skating today has a become a popular recreational activity for sports enthusiasts of all ages.

Unfortunately, many of the in-line roller skate wheels have cores with undesirable air bubbles. These air bubbles occur during molding and result in structural faults in the cores. Not only are air bubbles unsightly, distracting and ugly, but they weaken the structural integrity of the cores and wheels. Air bubbles can decrease the impact resistance of the cores and skate wheels and can lower the compression and tensile strength of the cores and skate wheels. Air bubbles can also adversely effect the maximum torque and torsion of the cores and can decrease the bending capacity and flexibility of the cores. Air bubbles can further cause core fracture, splitting and damage and can cause wheel failure making the skate wheels unsafe to use. Moreover, air bubbles blemish the overall appearance and quality of the cores and skate wheels.

It is, therefore, desirable to provide improved skate wheels and cores for in-line roller skates which overcome most, if not all, of the preceding problems.

SUMMARY OF THE INVENTION

Improved high performance skate wheels and cores without air bubbles are produced for in-line roller skates for greater strength, speed, maneuverability and control. The improved skate wheels and cores have greater impact resistance, higher torque and torsion capabilities, enhanced bending capacity, better flexibility and resilience, and superb quality. Desirably, the improved in-line roller skate wheels and cores are safer, impressive to use, durable and attractive. High performance in-line roller skates equipped with the improved skate wheels and cores are efficient, effective, and economical. Advantageously, the high performance in-line roller skates wheels and cores can be readily produced by the improved molding process and have superb marketing and advertising appeal.

To this end, the improved user-friendly in-line roller skates each have a set of light weight tandem, permeable wheels that are positioned generally in alignment with each other. Each of the wheels comprises a gas permeable, rigid or semi-rigid, core. The gas permeable core has: a hub with at least one bearing seat, spokes that extend radially outwardly of the hub, an outer portion with a tire-engaging surface which is secured to the spokes, and at least one opening for passage of gases during molding of the core to prevent air and other gas bubbles from forming in the core. Each of the wheels also has at least one bearing, seated on the bearing seat of the hub, and a tire which is securely mounted on the core against the tire-engaging surface of the gas permeable core.

The gas passage openings in the gas permeable core can comprise vent holes, air channels, or passageways. In the preferred form, the gas passage openings comprises micropores or apertures which extend through the tire-engaging surface of the gas permeable core at a location which is positioned radially outwardly of the spokes. The core can have a hollow outer portion and annular shell with an internal passageway which communicates with the gas passage opening (s) in the gas permeable core.

The spokes and hub can be solid or hollow. The gas permeable core can have a pitted rim or other pitted portions with spikes, indentations, holes or protuberances which can reduce air deflection, swirling and turbulence.

The gas permeable core of the in-line roller skate wheel can comprise complementary or symmetrical core sections. The core sections can be connected by pins and sockets which are preferable hollow to form tunnels which provide additional gas passage openings. In one form, the core has interlocking fingers which connect inner and outer core sections. The core sections can also be rotatively secured by interlocking circumferential fingers or joints which can comprise protrusions and recesses to minimize separation of the core sections during shear loads and impact. The core sections can further be welded together, such as by ultra sonic welding. Moreover, the core sections can have raised portions or protuberances which are located on the inner surfaces of the shell to facilitate welding. Other connecting means can also be used to secure the core sections to each other.

The spokes can be separated by circular openings and have semi-circular concave sides. The spokes can be separated by diverging openings and have sides with flat or planar portions.

The preferred process for producing wheels for in-line roller skates comprises molding a gas permeable core with at least one bearing seat and a tire-engaging surface such that passageways are formed in the core during molding. Molding can comprise injecting polyurethane or other thermosetting plastic or polymer by an injection nozzle(s) into a core-shaped opening of a vented mold such as a special three piece mold. The mold can have micropores or micropore-forming components to form apertures, small holes or micropores providing the gas passageways in the core. Separate tools, fixtures or instruments can also be used to form the micropores in the core. Air and other gases produced during molding can be vented through the passageways and drawn (sucked) out of the core and/or the mold, under vacuum pressure as the polyurethane or polymer is solidifying to substantially prevent air bubbles and other gas bubbles (gaseous bubbles) from forming or remaining in the core. Such a procedure helps enhance the structural strength and integrity of the wheel.

To further minimize the formation of air bubbles and other gas bubbles from forming in the core during molding, gas deflection can be decreased and gas turbulence can be dampened during molding. This can be accomplished by forming deflectors in the core or by pitting the core, such as the core's inner rim with deflectors or by pits comprising spikes or radial indentations. Such deflectors or pitting can be formed from spiked portions or protuberances in the mold or with other sharp instruments.

A more detailed explanation of the invention is provided in the following description and claims taken in conjunction with the accompanying drawings.

DETAILED DESCRIPTION OF THE PREFERRED EMBODIMENTS

Figure 1:
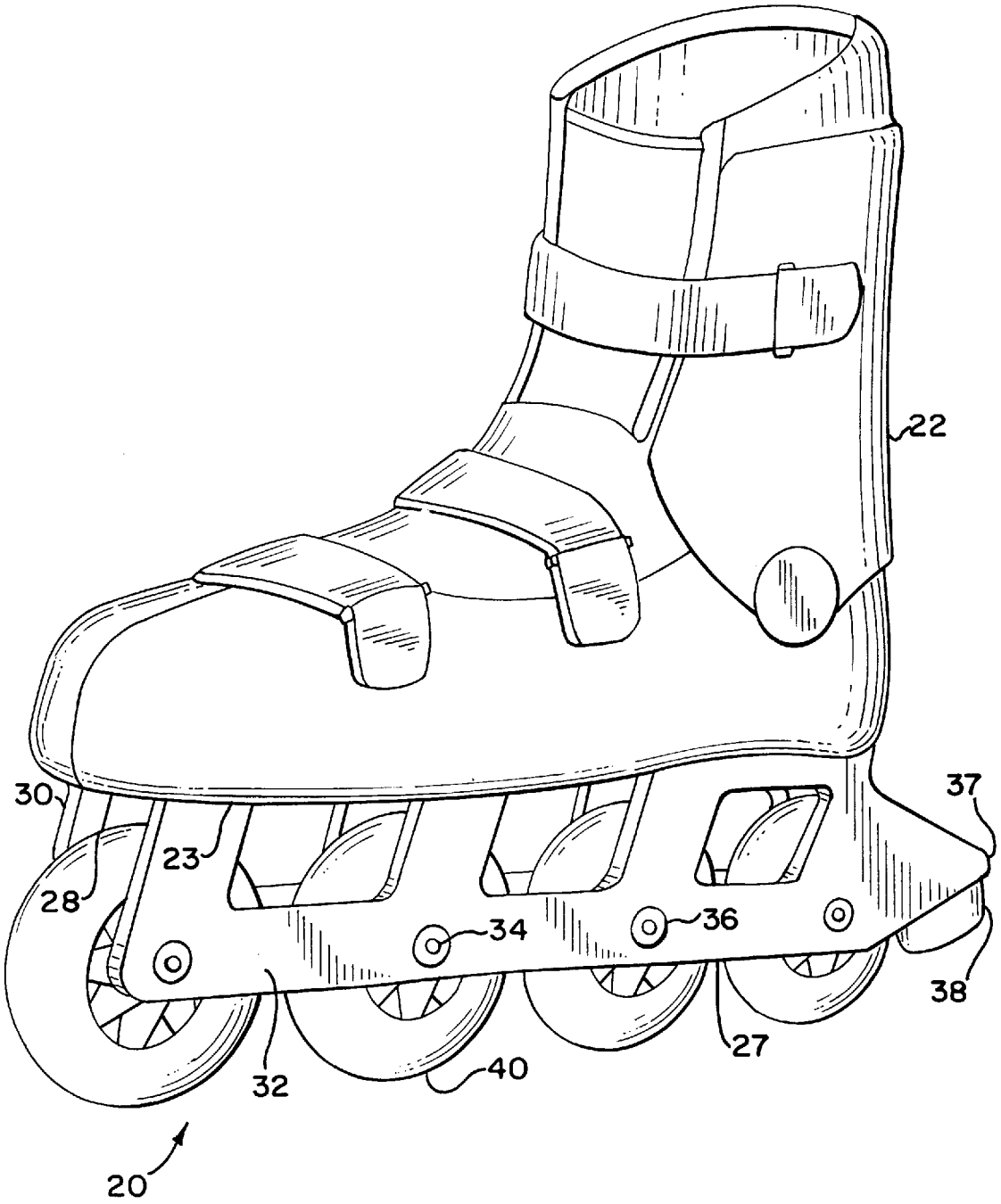
FIG. 1 is a perspective view of an in-line roller skate in accordance with principles of the present invention.
Figure 2:
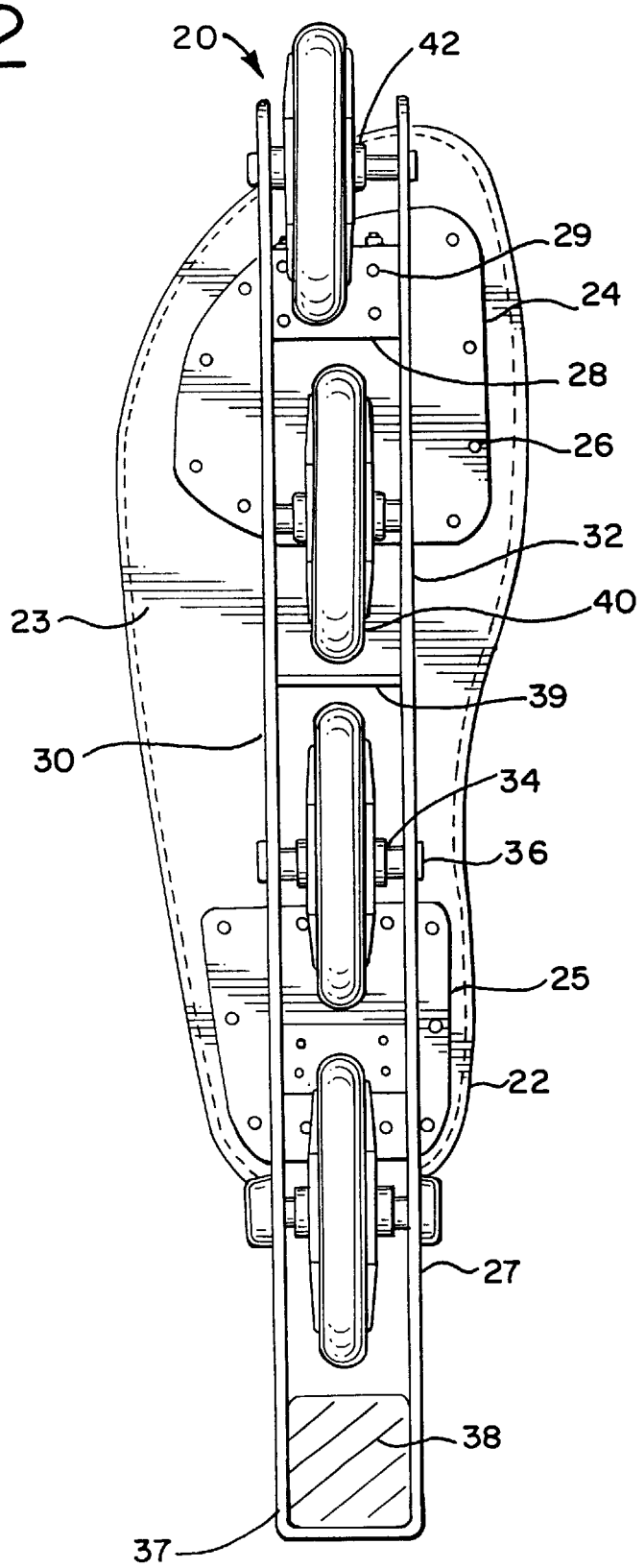
FIG. 2 is a bottom view of the in-line roller skate with one of the wheels adjusted to an offset position.

FIGS. 1 and 2 of the drawings illustrate a high performance in-line roller skate 20. The roller skate has a boot 22 with a sole 23. The boot can have laces or straps. The sole can have toe and heel support plates 24 and 25 (FIG. 2) which can be fastened to the sole by rivets 26 or screws or otherwise secured thereto. The boot provides protection and support to the foot and ankle of the skater. A wheel-supporting bracket skate frame providing a chassis 27 is mounted or otherwise attached to the sole of the boot. The chassis can be channel-shaped with upper horizontal intermediate sole-connecting plate sections 28 which can be fastened by rivets 29 or bolts or otherwise secured to the sole or toe and heel support plates of the sole. The chassis can have a pair of vertical sides 30 and 32 which can comprise flanges or rails that extend downwardly from the plate sections. The frame can be made of metal or plastic, e.g. fiberglass reinforced nylon.

An array of aliquotly 2–6 spaced axles 34 or shafts are mounted transversely across the sides of the chassis. The axles can comprise rivets or bolts secured by locknuts 36. The axles rotatably support a series, set or array of 2–6 high performance, light weight, narrow wheels 40. Each of the axles can have a shaft diameter of at least 9 mm for greater bending and shear strength.

The chassis can also be connected to a separate or integral U-shaped rear frame section 37 with a brake assembly or rear brake 38 fastened thereto. One or more transverse reinforcing ribs 39 can extend between and connect the sides of the chassis between the wheels.

The high performance, light weight in-line tandem skate wheels 40 are longitudinally aligned in registration with each other in a single row in a straight line in the direction of movement of the skater. Adjustable fasteners 42 can be attached to the axle to accommodate pronation adjustable wheels, i.e. for lateral adjustment and offset of the wheels. The wheels can also be adjusted for angular mounting on the axles to enable the skater to attain improved traction during turns. Each of the light weight wheels 40 can be thin and weigh substantially less than 72–100 grams, such as 30–60 grams, to substantially minimize axial torque, torsion and skewing.

Each wheel also includes a light weight, gas permeable or air permeable plastic composite vented core 100 without air bubbles and other gas bubbles attain greater strength, skating speed, maneuverability and control. The core can be molded in one or more parts from nylon reinforced with Kevlar polyaramid fibers, polyurethane or other moldable polymers reinforced with carbon fibers or other types of fibers. The core includes a high performance hub 102. The hub comprises an annular central portion of the core and has an inner hub surface 104 and an outer hub surface 106.

A light weight high performance tire 110 can be mounted on the gas permeable core against the outer tire-engaging surfaces of the core. For greater stability and ride quality and to better enable the tire to hold the surface of the pavement, as well as to minimize undesirable tilting, skewing, and tread squirm, the ratio of the vertical spacing between the outside diameter (outer thread surface) of the tire and the outer rim 114 of the core to the lateral spacing between the lateral outer side of the tire and the outer rim can range from 0.3 to 0.8.

Figure 4:
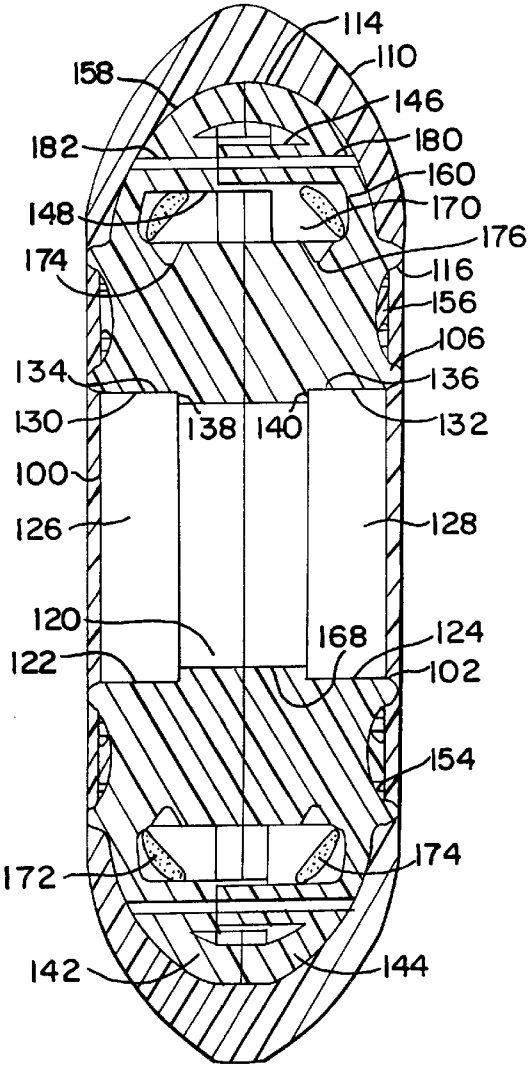
FIG. 4 is a cross-sectional view of the in-line roller skate wheel taken substantially along lines 4—4 of FIG. 3.
Figure 3:
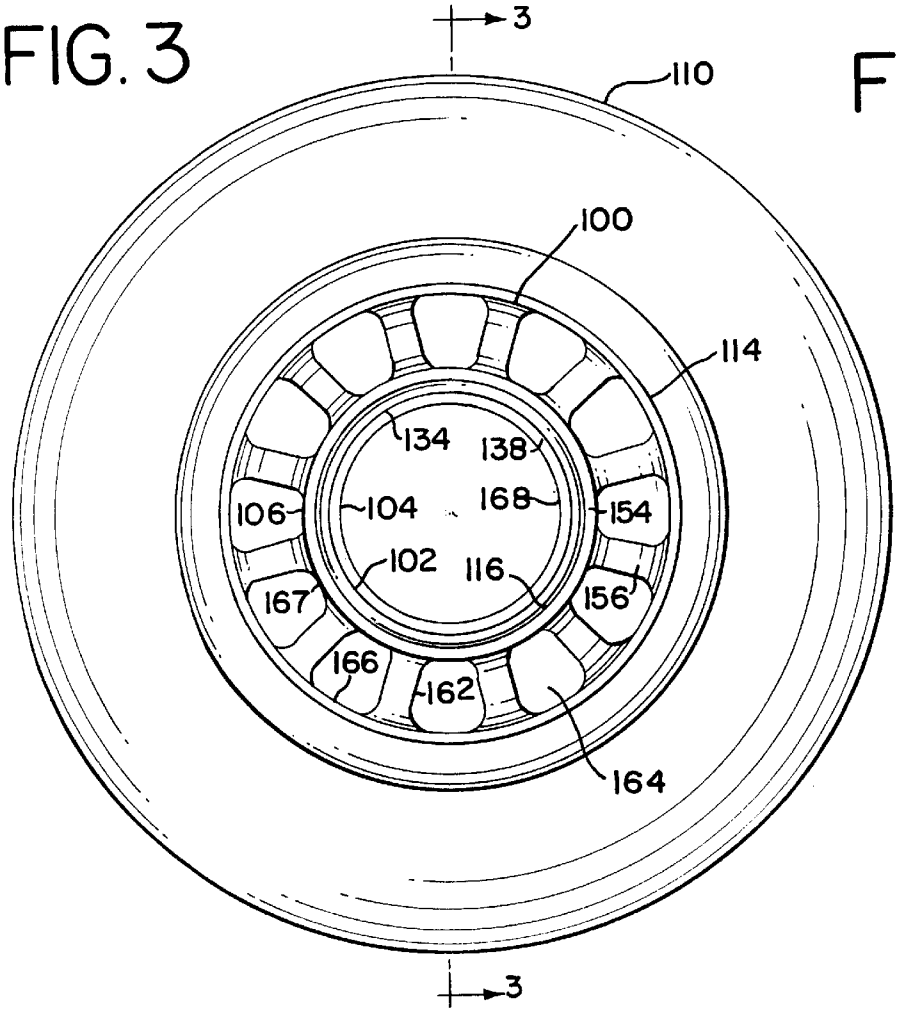
FIG. 3 is a front view of an in-line roller skate wheel in accordance with principles of the present invention.

The tire 110 (FIGS. 3 and 4) annularly surrounds and is secured to the hub about the rims of the gas permeable core. The tire can comprise a high strength solid non-pneumatic tire with a tensile strength ranging from 26,000–40,000 psi and a hardness ranging from 60–85 durometers on the D Scale. The maximum tire thickness can be greater than the maximum transverse span or width of the core's inner rim 116, as well as the core's outer rim, i.e. $\geqq 1$. The ratio of the inner rim width of the core to the thickness (width) of the tire can range from 0.6 to 0.9. Furthermore, the hub width may not be the same as the inner rim width. The ratio of the hub width to the inner rim width can be >1.

The profile of the tire can be greater than 180 degrees and preferably ranges from 210–340 degrees, most preferably 300–330 degrees. The tire can also have threads on its outer surface. The tire can be made of thermosetting or thermoplastic polyurethane. In some circumstances, it may be desirable to mold the tire out of other elastomeric materials or that the tire be semi-solid, hollow or pneumatic.

Skate wheels and cores can be injection molded or cast molded. Wheels and cores can also be made in different sizes and weights depending on the age, height, and weight of the skater (customer) and the intended use of the in-line roller skates. Some of the many sizes that skate wheels can be molded are the following wheel diameters (maximum outside diameter) expressed in mm: 47, 54, 57, 60, 64, 65, 70, 72, 75.5, 76, 77.5, 80 and 82.

Each skate wheel can weigh 30–60 grams to minimize axial torque, torsion and skewing. The ratio of the total weight of wheel (in grams) to the maximum outside diameter of the wheel (in mm) can be <1 or <1:1, preferably ranges from 0.4:1 to 0.9:1 and most preferably ranges for 0.69:1 to 0.75:1. For example a wheel having an outside diameter (OD) of 80 mm would weigh 55–60 grams. This is substantially lighter, about 31%–42% lighter, than prior art 80 mm wheels which usually weigh 80–85 grams. The skate wheels can be of a light enough weight and density to float in water.

As discussed previously, the axles in the skate frame (chassis) rotatably support a series, set or array of wheels. Each axle can comprise an intermediate cylindrical or annular axle portion 120 (FIG. 4) and smaller diameter, axially opposed axle bearing seats 122 and 124 providing outwardly extending, outer bearing-receiving portions. The axles can be hollow or solid. Light weight bearings 126 and 128 are press fit and mounted or otherwise secured to the axle bearing seats. Each bearing can weigh 4–12 grams and can have a maximum width of 2–7 mm. Each bearing can have a diameter of 22 mm. The bearings can be a 608 ZZ bearing size with dust shields. The outer bearing surfaces 130 and 132 of the bearings are press fit or secured by a friction fit to the hub's bearing seats 134 and 136 and raised bearing shoulders 138 and 140, respectively.

The gas permeable high performance core 100 can weigh 10–50 grams to attain greater skating speed and can be reinforced with fibers, such as polyaramid fibers or carbon fibers for greater strength. The core can comprise symmetrical or complementary core sections 142 and 144. The complementary cores sections can include a left side core section 142 and right side core section 144, as viewed from the front of the in-line skate. The core sections matingly engage and are secured to each other. The core sections have interlocking pins 146 and sockets 148 or circumferential fingers providing joints comprising protrusions and recesses which snap fittingly engage and securely lock into each other when rotated in the circumferential direction to minimize and prevent separation of the core sections under sheer forces, loads, and impact.

The interior or inner surface 150 of the core can have inwardly extending welding protuberances comprising raised portions to facilitate ultra sonic welding of the core sections. The welding protuberances can include: (a) outer semi-circular curved welding protuberances adjacent the beveled or tapered outer rim or edge of the core providing the outside diameter of the core; (b) intermediate curved arcuate welding protuberances adjacent the core's inner rim; (c) inner curved arcuate welding protuberances adjacent the hub's inner surface 162 of the hub 161, and (d) radial welding protuberances on the inner surfaces on at least some of the spokes. In some circumstances, it may be desirable to secure the core sections to each other by other connecting means such as: friction welding, spin welding, chemical bonding, adhesive, glue, tape, screws, or other fasteners.

The gas permeable core can be rigid or semi-rigid. Portions of the core can be solid or hollow. The radially inner portion of the core 154 comprising the hub and 8–12 spokes 156 (FIG. 5) can be solid or hollow. The radially outer portion of the core is hollow and comprises an annular tubular shell 158. The shell provides an annular outer spoke or imperforate ring which integrally extends between and connects the inner rim and the outer rim of the core. The core's outer rim can have a planar or flat exterior surface or face. The inner, inwardly facing interior surface 160 (FIG. 6) of the annular hollow shell is curved, arcuate and concave. The outer exterior surface 112 of the shell is curved, arcuate, and convex. The outer shell surface 112 provides a convex, annular, tire-engaging surface. The shell can be reinforced with radial or transverse ribs, discs, or segments. In some circumstances, it may be desirable that the shell be solid or of a different shape or configuration.

As discussed above, each of the high performance skate wheels features an air or gas permeable plastic vented core 100 (FIGS. 3–6) without any air bubbles for enhanced strength and performance. The core has an annular central portion providing a hub 102 with bearing seats 134 and 136 in press fitting engagement with the bearings 124 and 126. An intermediate hub portion 168 with raised shoulders 138 and 140 separate the bearing seats. The intermediate hub portion is positioned about the intermediate axle portion 120 of the skate frame's axle.

The permeable vented core has an inner rim 116 which is positioned about the hub. The core's outer rim 114 is positioned about the core's inner rim. The core's annular hollow shell 158 extends radially between and integrally connects the core's inner and outer rims. The annular hollow shell has a concave inner surface 160 and a convex outer tire- engaging surface 112. The annular hollow shell also provides a hollow interior compartment which defines an annular interior passageway 170.

A set of spokes 156 extend radially between and connect the outer hub surface 106 to the inner rim 116. The sides 162 of the spokes can be generally planar or flat except for the rounded corners adjacent the inner rim and hub. The diverging openings 164 provide spoke openings between the spokes. The outer portions 166 of the spoke openings are longer than the inner portions 167 of the spoke openings. The sides of the spokes can also be semi-circular, curved and concave and, if desired, there can be circular openings (spoke openings) between the spokes. In some circumstances, it may be desirable to use a different number of spokes and spoke openings or use spokes and spoke openings with different shapes and configurations. It may also be desirable in some circumstances, that the spokes directly connect the outer hub surface and outer rim.

Figure 6:
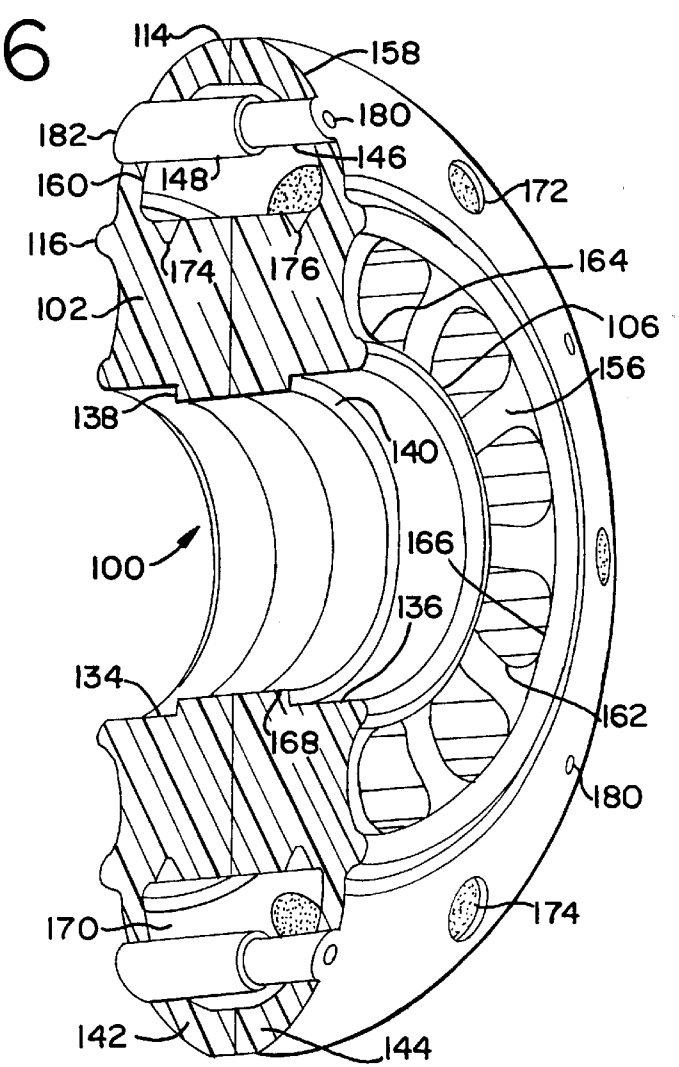
FIG. 6 is a cross-sectional perspective view of the core substantially along lines 5—5 of FIG. 5.
Figure 5:
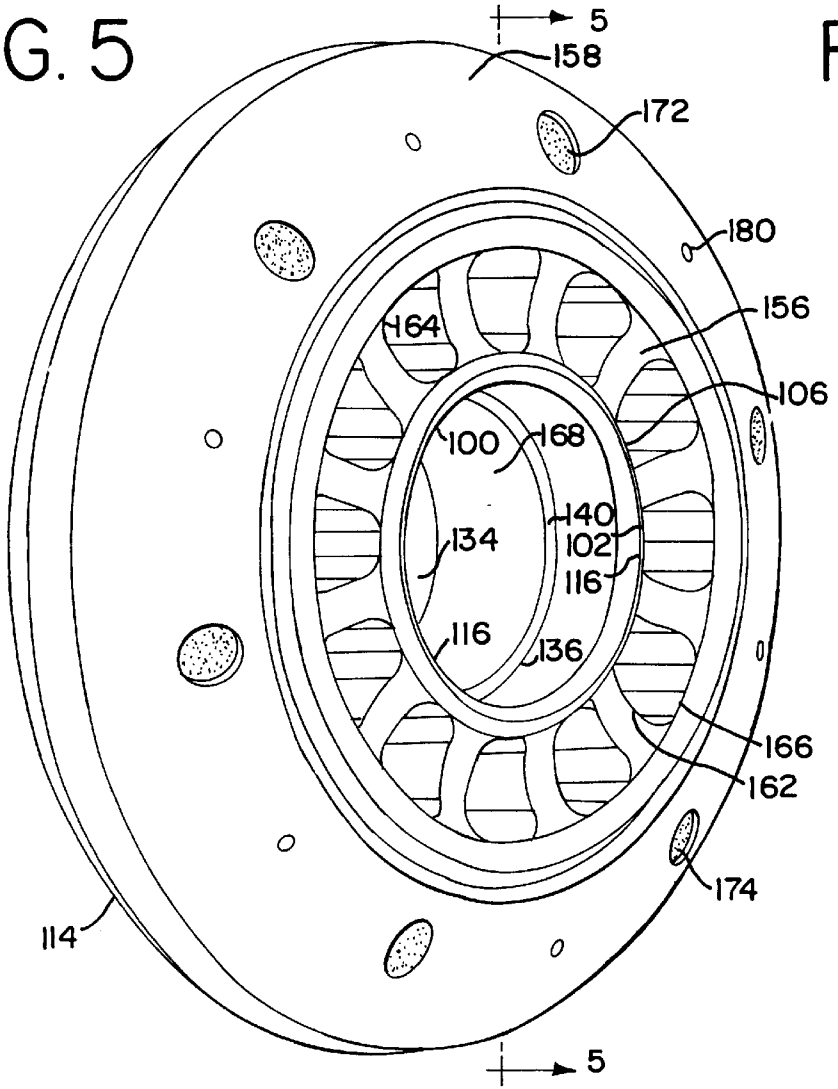
FIG. 5 is a perspective view of the core.

In order to vent and increase the permeability of the air and gas permeable core to attain enhanced strength and performance, the preferred core has a circular array, set or series of micropore zones 172 (FIGS. 5 and 6). The micropore zones provide transverse permeable areas in the annular hollow shell at a location radially outwardly of the spokes. The micropore zones comprise micropores 174 or apertures which extend through the shell 158 between the shell's outer tire-engaging surface and the shell's concave inner surface. The micropores or apertures communicate with the annular passageway 170 in the hollow interior compartment to permit passage and egress of air and other gases out of the core. In the preferred embodiment, the micropore zone comprise indented, substantially circular micropores areas or zones. Preferably, each of the micropore zones comprise 30–40 micropores or apertures. The micropores or apertures can comprise pin holes or small holes and can range in size from 0.1 to 20 microns or larger. In the illustrated embodiment, the micropore zones are closer to the core's inner rim then the core's outer rim. Also, in the illustrated embodiment, the micropores and apertures are spaced radially outwardly out of the spoke openings 164 between the spokes 156.

The core's inner rim can also comprise a pitted internally spiked rim with radial indentations 176 and 178, pits or spikes to decrease air deflection and gas turbulence. In the preferred embodiment, the indentations comprise a set or series of parallel annular circumferential indentations 176 and 178 which extend radially inwardly into core's inner rim. The indentations can comprise truncated holes, conical holes or frusto-conical holes.

As previously discussed, the permeable core has complementary or symmetrical core sections 142 and 144. Interlocking pins 146 and the sockets 148 can connect the complementary core sections. In order to enhance the permeability and ventilation of the core, the pins and sockets can be hollow to provide tunnels or holes 180 and 182 for passage of air of the other gases through the core sections of the permeable core.

A non-pneumatic tire can annularly surround the hub and securely engage the shell's outer convex tire-engaging surface 112 and core's outer rim 114. The high performance tire can be chemically bonded or otherwise secured to the tire-engaging shell surface and core's outer rim. The tire can be cast or injection molded and made of cast thermosetting urethane or polyurethane and can be asymmetrical. The tire can have a hardness of 76–96 durometers on the a scale. The tire is preferably a solid non-pneumatic tire which annularly surrounds the hub. If desired, the tire can have a tensile strength less than 10,000 psi and can be made of other materials or elastomers. Because of the tire-engaging shell surface, mechanical locks are not necessary but can be used if desired.

Figure 8:
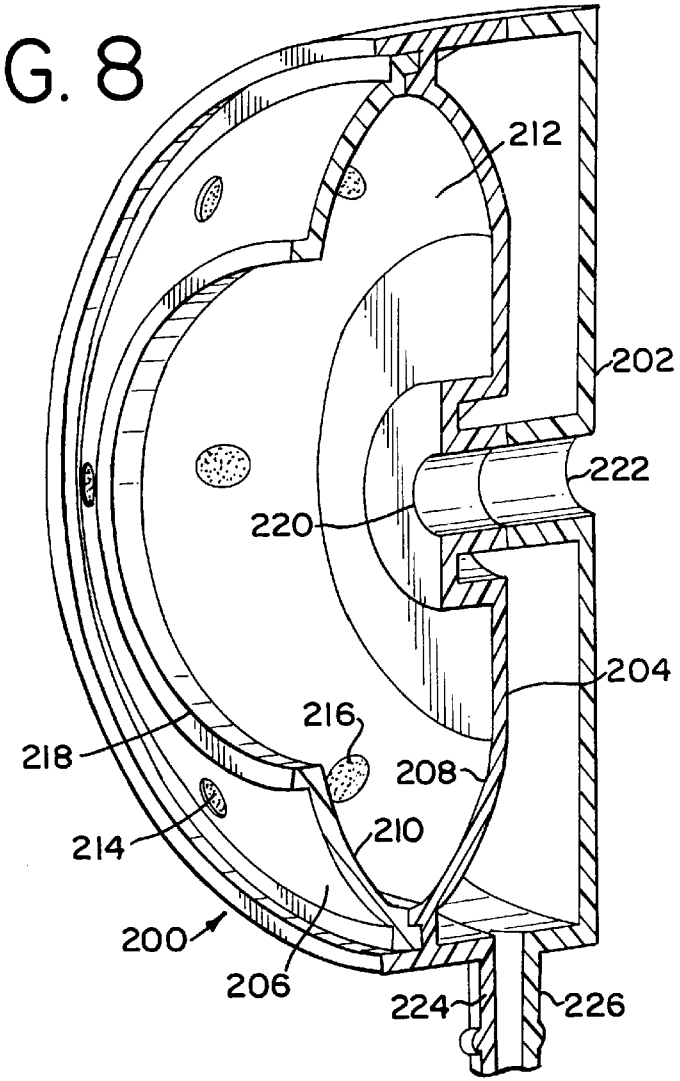
FIG. 8 is a cross-sectional view of part of the mold taken substantially along lines 7—7 of FIG. 7.
Figure 7:
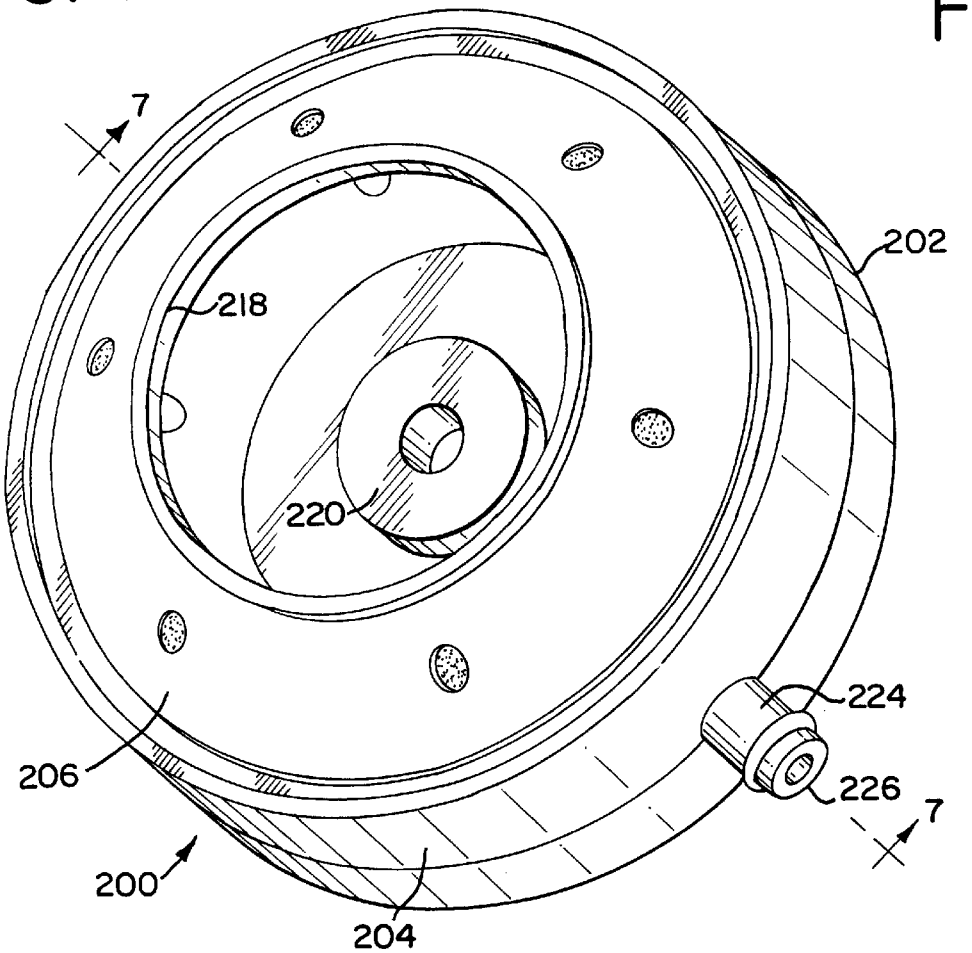
FIG. 7 is a perspective view of a mold for producing part of the in-line roller skate wheel.
Figure 10:
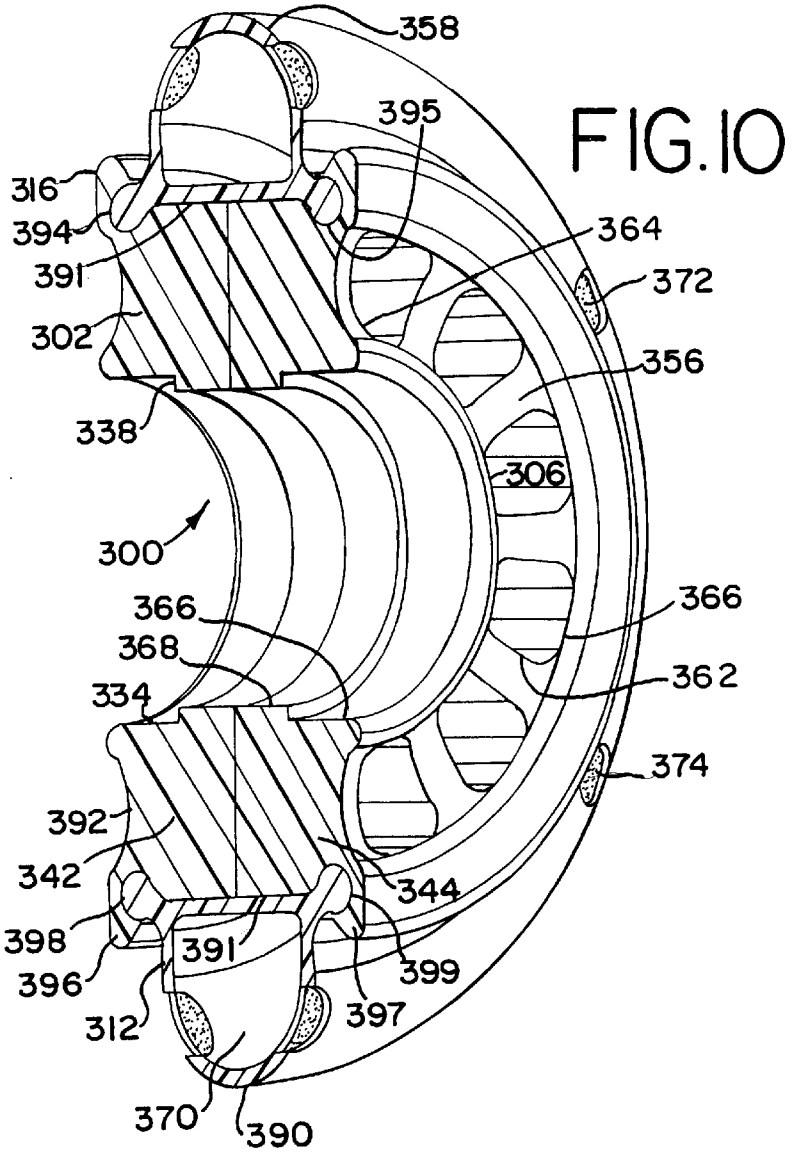
FIG. 10 is a cross-sectional perspective view of the core of the in-line skate wheel of FIG. 9.
Figure 9:
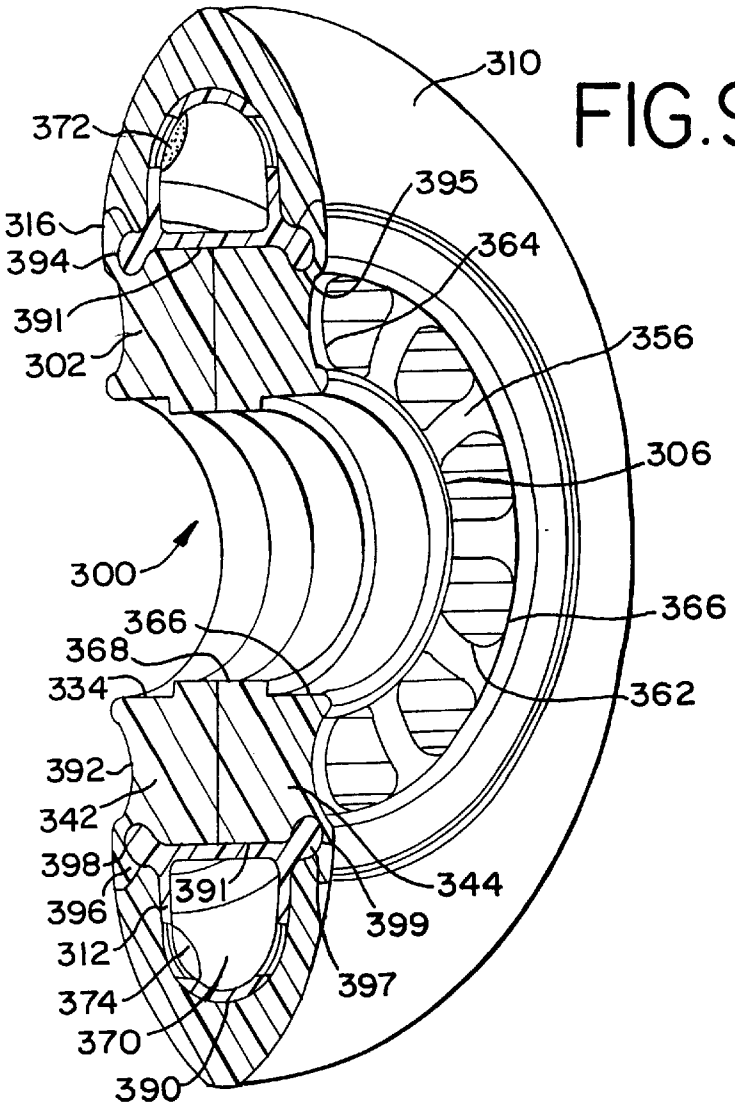
FIG. 9 is a cross-sectional perspective view of another in-line skate wheel in accordance with principles of the present invention.
Figure 11:
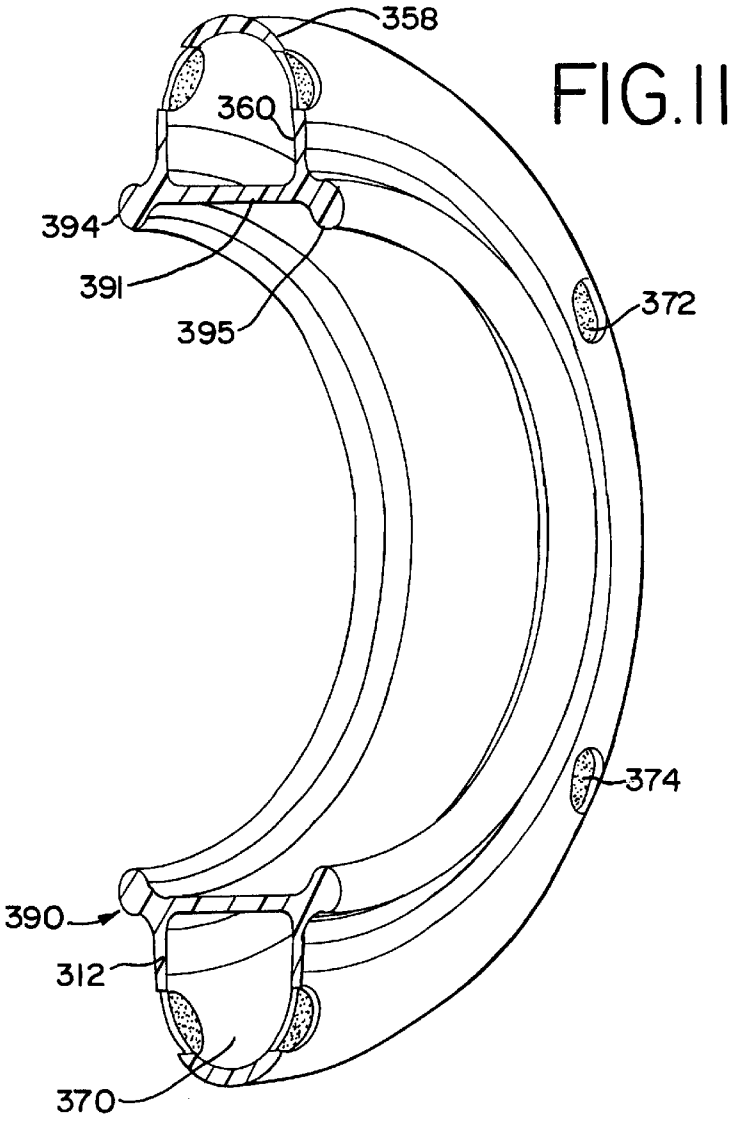
FIG. 11 is a cross-sectional perspective view the outer part of the core of FIG. 10.
Figure 12:
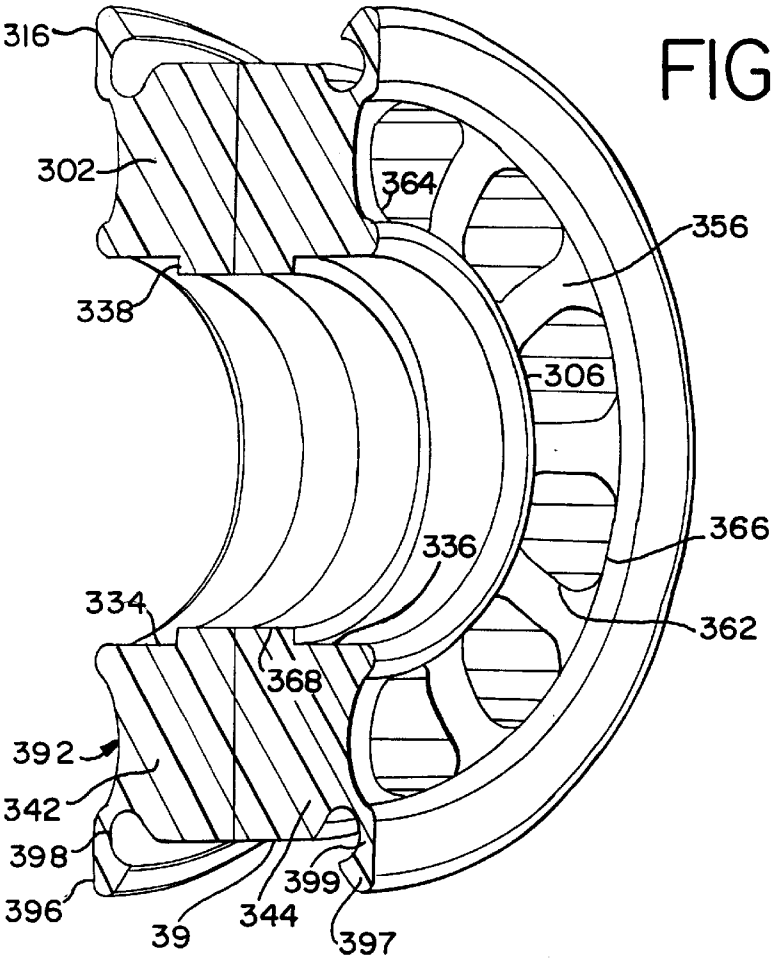
FIG. 12 is a cross-sectional perspective view of the inner part of the core of FIG. 11.

A three piece multi-piece (section) mold, such as shown in FIGS. 7 and 8 can be used to mold, fabricate and produce the air and gas permeable core and high performance skate wheels. The mold can comprise three pieces sections including a vented base section 202, a vented intermediate section 204 and a vented outer section 206. The vented mold is shaped generally complementary to the core. The inner surfaces 208 and 210 of the intermediate and outer mold sections are concave and cooperate with each other to provide a core-shaped opening 212 therebetween. The inner surface of the intermediate and outer mold sections have a circular array, series or set of circular micropore zones 214 and 216. The mold's micropore zones comprise spikes, protuberances, or other micropore-forming portions to form micropores or apertures in the core. The outer mold section has a nozzle-receiving opening 218 into which an injection nozzle is placed during the molding process. The injection nozzle injects and pours thermosetting polyurethane or other moldable plastic into the mold's core-shaped opening.

The central portions of the intermediate and base mold sections define as central passageways providing vents 220 and 222 for passage of air and other gases out of the mold. Radial vent or tube section 224 and 226 provide a radial vent or tube which extends radially outwardly of the intermediate and base sections of the mold. The radial vent can be used to create a vacuum and draw and suck air out of the core and mold. The radial vent can also communicate with the micropore zones of the mold and core for further venting and passage of air and other gases from the core during the molding process.

One preferred process for producing in-line roller skate wheels comprise molding gas permeable core's with at least one bearing seat and a tire-engaging surface, as previously described, such that passageways providing vent holes or vents are formed in the core during molding. Molding can comprise by injecting polyurethane or other thermo-setting plastic by an injection nozzle(s) into the core-opening of the vented mold during molding. During molding, the mold forms apertures, small holes or micropores in the core to provide the air and gas passageways or vents in the core. Air and other gases produce during molding are vented through gas passageways and drawn out of the core under vacuum pressure as the core is solidifying to prevent air bubbles and other gas bubbles from forming or remaining in the solidied core. Such a procedure helps to enhance the structural strength and integrity of the core.

To further minimize the formation of air bubbles and other gas bubbles from forming in the core during molding, gas deflection can be decreased and gas turbulence can be dampened during molding. This can be accomplished by forming deflectors in the core or pitting the core. Preferably, this is accomplished by molding the core's inner rim with deflectors or pits, comprising spikes or radial indentations with spiked portions or protrudence in the mold or with other sharp instruments.

The in-line skate wheels of FIGS. 9–12 is structurally and functionally similar to the previous described in-line skate wheels of FIGS. 3–6, except as described below. For ease of understanding, similar parts and components have been given similarly part numbers as the parts and compartments previously described in FIGS. 3–6, except in the 300 series, such as core 300, hub 302, spokes 356, etc.

The gas and air permeable core 300 (FIGS. 9 and 10) has an outer core part or section 390 and inner core part or section 392. The outer core part 390 (FIG. 11) comprises the annular hollow shell 358 upon which the 310 is mounted. The outer core has an intermediate bridging section 391 providing a generally planar or flat bight and has a parallel set series and array of inwardly diverging, convex round, circumferential fingers 394 which extend radially inwardly and laterally outwardly at an angle of inclination from the bight. The interlocking fingers 394 and 395 are located along and adjacent to the core's composite inner rim 316. The intermediate bridging section extends laterally between and connects the circumferential fingers. The inner surfaces 360 of the shell cooperates with and are spaced from the bridging section to define an annular passageway 370 which communicates with the micropores 374 or apertures in the micropore zones 372. The micropores extend through the shell.

The inner core part 392 (FIG. 12) can comprise complementary core sections 342 and 344. The inner core part includes the inner rim 316, spokes 356 and hub 302. The inner rim has a parallel set, series and array of symmetrical bifurcated, U-shaped fingers 396 and 397. The bifurcated U-shaped fingers provide U-shaped circumferential inner locking grooves 398 and 399 which diverge radially inwardly to snugly receive and interlockingly engage the circumferential fingers 394 and 395 (FIGS. 9 and 10) of the outer core part. An outer intermediate connecting surface 393 extends between the grooves and bifurcated fingers. The outer intermediate surface is generally flat or planar and slidably receives and abuttingly engages the bridging section of the outer core part.

Among the many advantages of the in-line roller skate wheels, cores and process are: (1) Greater wheel and core strength; (2) Superb performance; (3) Excellent speed; (4) Good control and maneuverability; (5) Better appearance; (6) No air bubbles; (7) Outstanding marketing, advertising, and promotional appeal; (8)Decreased dynamic static moment of inertia along the longitudinal, horizontal and vertical axes, i.e. roll, yaw, and pitch; (9) Quicker camber changes; (10) More like ice-skate blades; (11) Reduced mass; (12) Superior quality; (13) Impressive; (14) Easy to use; (15) Economical; (16) Attractive; (17) Efficient; (18) Effective; (19) Reliable and (20) Safer.

Although embodiments of the invention have been shown and described, it is to be understood that various modifications and substitutions, as well as rearrangements of parts, components, and process steps, can be made by those skilled in the art without departing from the novel spirit and scope of this invention.

What is claimed is:

1. An in-line roller skate, comprising:

a set of permeable wheels, each of said permeable wheels comprising a gas permeable core having a hub with at least one bearing seat, spokes extending radially outwardly of said hub, an outer portion having a tire-engaging surface secured to said spokes and at least one opening for passage of gases during molding of said core to substantially prevent air bubbles in said core;

a bearing securely seated on said bearing seat of said hub;

a tire securely mounted on said core and positioned against said tire engaging surface of said outer portion of said gas permeable core; and wherein said gas permeable core comprises complementary core sections and at least one pin connecting said core sections, and said pin comprising a hollow pin defining a tunnel providing said opening.

2. An in-line roller skate in accordance with claim 1 wherein said gas permeable core comprises a rigid core and said opening comprises a vent hole.

3. An in-line roller skate in accordance with claim 1 wherein said gas permeable core comprise a semi-rigid plastic core and said opening comprises an air channel.

4. An in-line roller skate in accordance with claim 1 wherein said openings comprises apertures extending through said tire-engaging surface at a location radially outwardly of said spokes.

5. An in-line roller skate in accordance with claim 1 wherein said outer portion of said core comprises a hollow outer portion defining an internal passageway communicating with said opening.

6. An in-line roller skate in accordance with claim 1 wherein said core has an inner core section and an outer core section extending radially outwardly of said inner core section, and said core has interlocking fingers connecting said inner and outer core sections.

7. An in-line roller skate in accordance with claim 1 wherein said openings comprise micropores.

8. An in-line roller skate, comprising:

a boot having a sole;

a wheel-supporting bracket skate frame providing a chassis attached to said sole;

a series of light weight high performance wheels positioned substantially in longitudinal alignment in the direction of movement of the skater;

an array of aliquotly spaced axles providing shafts mounted transversely in said frame for rotatably supporting said wheels, each of said axles comprising an intermediate axle portion and small diameter, axially opposed, outer bearing-receiving axle portions extending integrally outwardly of said intermediate axle portion;

each of said wheels comprising a pair of bearings mounted on said outer axle portions;

an air permeable plastic core for enhanced strength and performance, said core comprising substantially complementary core sections matingly engaged and secured to each other, said air permeable core having an annular central portion providing a hub with bearing seats in press-fitting engagement with said bearings, an intermediate hub portion with raised shoulders separating said bearing seats and disposed about said intermediate axle portion, and an outer hub surface;

an inner rim positioned about said hub;

a set of spokes extending radially between and connecting said outer hub surface to said inner rim;

an outer rim positioned about said inner rim;

an annular hollow shell extending radially between and integrally connecting said inner and outer rims, said annular hollow shell having a concave inner surface and a convex outer tire-engaging surface and providing a hollow interior compartment defining an annular passageway; and a substantially circular array of microprobe zones providing transverse permeable areas in said annular hollow shell at a location radially outwardly of said spokes, said microprobe zones comprising microprobes extending through said shell between said outer tire-engaging surface and said concave inner surface and communicating with said annular passageway in said hollow interior compartment to permit passage and egress of gas out of said core;

a non-pneumatic tire annularly surrounding said hub and securely engaging said convex outer tire-engaging surface of said annular hollow shell and said outer rim of said gas permeable core.

9. An in-line roller skate in accordance with claim 8 wherein said micropore zones comprise indented substantially circular micropore zones and said micropores comprise apertures.

10. An in-line roller skate in accordance with claim 8 wherein said micropores zones each comprise 30–40 micropores and said micropore zones are closer to said inner rim than said outer rim.

11. An in-line roller skate in accordance with claim 8 wherein said complementary core section include interlocking pins and sockets connecting said complementary core sections, said pins and sockets being hollow and defining tunnels for passage of gas through said gas permeable core.

12. An in-line roller skate in accordance with claim 8 wherein said inner rim comprises a pitted internally spiked rim with radial indentations to decrease gas deflection, and said indentations are selected from the group consisting of truncated holes, conical holes and frusto-conical holes.

13. An in-line roller skate in accordance with claim 8 wherein said core has an outer core part and an inner core part, said outer core part comprises said annular hollow shell and a pair of inwardly diverging convex circumferential fingers extending radially inwardly and laterally outwardly from said shell at a location radially opposite said outer rim, said inner core part comprises said inner rim, spokes and hub, said inner rim comprising a pair of bifurcated U-shaped fingers defining a pair of U-shaped circumferential grooves diverging radially inwardly for slidably receiving and interlockingly engaging said circumferential fingers, and said inner core part comprises said complementary core sections.

14. An in-line roller skate in accordance with claim 8 wherein said spokes have generally planar sides, said permeable core defines diverging openings between said spokes, and said diverging openings are spaced radially inwardly of said micropores.

* * * * *